US005194027A

United States Patent [19]

Kruskopf et al.

[11] Patent Number: 5,194,027

[45] Date of Patent: Mar. 16, 1993

[54] SOLID SEAL FOR THIN FILM ELECTROLUMINESCENT DISPLAY PANELS

[75] Inventors: Mark S. Kruskopf, Portland; Kunmith Ping, Beaverton, both of Oreg.

[73] Assignee: Planar Systems, Inc., Beaverton, Oreg.

[21] Appl. No.: 756,815

[22] Filed: Sep. 9, 1991

[51] Int. Cl.[5] ..... H01J 9/24

[52] U.S. Cl. ..... 445/24; 445/25; 264/272.13; 264/272.16

[58] Field of Search ..... 445/24, 25; 264/272.16, 264/272.13

[56] References Cited

U.S. PATENT DOCUMENTS

| | | | |
|---|---|---|---|
| 4,364,168 | 12/1982 | Matsuyama et al. | 445/25 |
| 4,696,776 | 9/1987 | Hooker et al. | 264/272.13 |
| 4,802,873 | 2/1989 | Barrow et al. | 445/24 |
| 4,842,800 | 6/1989 | Walles et al. | 264/272.13 |

*Primary Examiner*—Richard K. Seidel
*Assistant Examiner*—Jeffrey T. Knapp
*Attorney, Agent, or Firm*—Chernoff, Vilhauer, McClung & Stenzel

[57] ABSTRACT

A construction for a TFEL panel includes a solid encapsulating layer for the active area of a TFEL panel that has a hardness that does not exceed 40 duromeers (Shore A). A gel material is spread over the active area and cured to the desired degree of hardness. At this degree of hardness the panel retains its self-healing characteristics and the panel's durability is much improved over designs using oil-filled cavitites.

2 Claims, 1 Drawing Sheet

SOLID SEAL FOR THIN FILM ELECTROLUMINESCENT DISPLAY PANELS

The following invention relates to a solid seal for encapsulating the active area of a thin film electroluminescent display panel and to a method for forming the seal that provides protection for the panel from the environmental effects of moisture, pressure and the like while retaining desireable self healing characteristics.

Thin film electroluminescent display panels comprise sets of front and back electrodes sandwiching a thin phosphor film which is excited and caused to emit light by the electric field established at intersection of the front and rear electrodes. Such panels are commonly referred to by the acronym TFEL and an example of such a device is shown in U.S. Pat. No. 4,897,319 entitled TFEL DEVICE HAVING MULTIPLE LAYER INSULATORS.

TFEL panels are extremely sensitive to moisture and if operated without a protective cover, the films tend to delaminate leaving dark regions in the display area. Prior solutions to this problem have involved encapsulating the active area of the TFEL display with a cavitated cover plate and filling the cavity with silicone oil. The problems with this approach are pointed out in U.S. Pat. No. 4,802,873 which is a method for covering the active area of a TFEL panel with a liquid material enclosed by a cavitated cover plate which cures to a solid material during the "burn-in" period of panel conditioning. These problems include leakage of oil (in the event of a crack in the cover plate) and the inability to maintain a liquid-filled cavity intact in hostile environments of high heat, humidity or pressure. Such environments might be encountered in situations where the panel is used as part of a weapons system or in some other military application.

Another problem with the use of any liquid, even in the initial stages of panel fabrication, is that the liquid must be placed in a cavity and all of the air in the cavity must be removed. Additionally, providing a cavity structure is expensive as it typically requires a glass plate which must be machined or must have a perimeter spacer. Any bubbles left remaining in the liquid are visually distracting and can interfere with the self-healing properties of the panel. Self-healing is the tendency of the panel structure to limit the propagation of pinhole sized burnouts caused by short circuits. With oils encapsulating the active panel area, such defects do not propagate because the aluminum from the electrodes at the site of the short circuit diffuses into the silicone oil.

One solution to the problems with oils would be to encapsulate the panel in a hard resin. We have discovered, however, that the efficacy of the self-healing effect is limited if the material covering the panel is too hard. In fact, hard encapsulants cause defects to propagate down a row or column of pixels.

SUMMARY OF THE PRESENT INVENTION

The use of a cavitated rear cover plate is unnecessary with the present invention which provides a TFEL panel which includes a substrate supporting an active light emitting panel comprising front and rear electrode layers sandwiching an electroluminescent layer and an encapsulating cover layer of a solid state material having a hardness of no greater than 40 durometers (Shore A).

The encapsulating cover is formed by placing a layer of a gel material on the active area of the TFEL panel so as to completely encapsulate the active area and curing the material to the desired degree of hardness.

It has been determined experimentally that if the encapsulating solid material is cured to a hardness of no greater than 40 durometers (Shore A), the panel will retain its self healing characteristics. When hard solid materials are used as encapsulants, it has been found that destructive arcs caused by short circuits that occur during the burn-in period can propagate down an entire row or column of pixels, essentially destroying the panel. The use of a softer yet solid material as an encapsulant allows point defects in the electrode structure to occur without propagating past the local area of the defect. A theory as to why this occurs is that with the aluminum conventionally used for rear electrode structures, vapor and combustion products from the short circuit are allowed to diffuse into the encapsulating material. This will occur as long as the material has a hardness that does not exceed 40 durometers (Shore A). This is also a characteristic of silicone oils, but for reasons explained above there are many drawbacks to the use of such oils, particularly in demanding environments.

Initially the gel material, which may be a silicone gel, is an amorphous mass which may be formed over the active area of the panel by screening, spraying, pouring or blading. Curing, depending on the exact nature of the material, may be by heat, ultraviolet light or chemical reaction (with a two part mixture). All such methods will work as long as the final material hardness does not exceed 40 durometers (Shore A).

If desired, a glass plate can be placed on top of the solid material to form a moisture-resistant cover. The best method of using the invention with a glass plate is to pour the material on top of the active area of the TFEL panel so that it forms a mound or dome, and then after placing a glass cover plate on the dome, depressing the cover plate so as to spread the material over the active area and squeeze excess material away from the panel at the edges of the plate. The excess is removed and the gel may then be cured to the requisite degree of hardness. The glass plate may be sealed against the substrate of the panel with an epoxy or other adhesive. This forms a vapor barrier to keep out moisture which could otherwise penetrate the encapsulating material and attack the panel.

It is a primary object of this invention to provide a protective encapsulating layer for the active area of a TFEL panel which is not only resilient and durable, but also promotes self-healing.

A further object of this invention is to provide a method of encapsulating an active TFEL panel which makes use of a curable gel to provide a solid seal of a predetermined hardness.

A still further object of the invention is to provide a method of encapsulating a TFEL panel that more easily eliminates bubbles in the encapsulating medium so that fewer panel defects occur.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
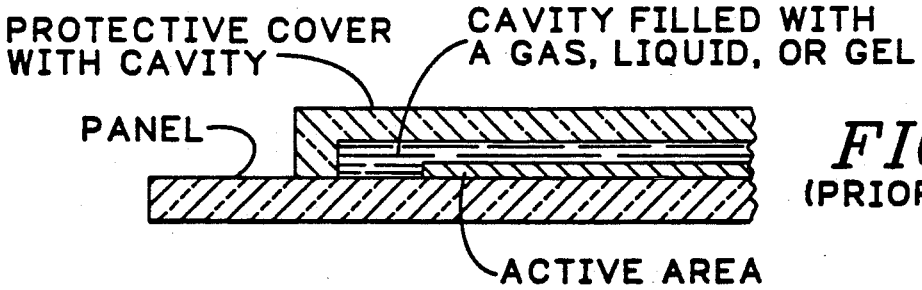
FIG. 1 (PRIOR ART)
FIG. 1 is a partial cutaway side view of a prior art TFEL panel enclosed by a cavitated cover plate.
Figure 1A:
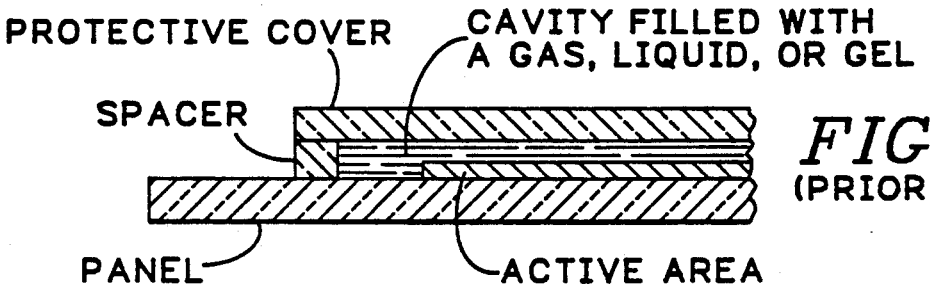
FIG. 1A (PRIOR ART)
FIG. 1*a* is a partial cutaway view of a prior art TFEL panel enclosed by a flat glass plate and a spacer.

Prior art panel constructions are illustrated in FIGS. 1 and 1(*a*). In FIG. 1 the active area of the TFEL panel is covered by a protective cover having a cavity where the cavity is filled with a gas, liquid, or gel. This requires the use of a cavitated cover plate which is difficult to machine. It is also difficult to fill the cavity without introducing bubbles. In the prior art embodiment of FIG. 1*a*, the protective cover is flat but requires a spacer in order to create the cavity which is to be filled with a gas, liquid, or gel.

Figure 2:
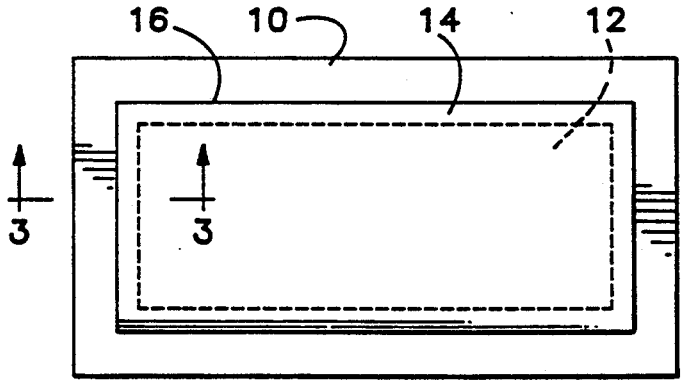
FIG. 2 is a top view of a TFEL panel employing the solid seal of the invention.
Figure 3:
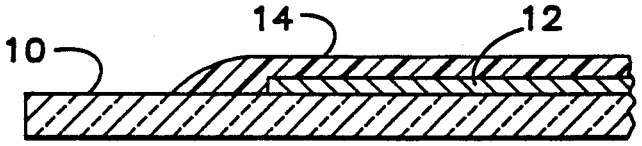
FIG. 3 is a partial side cutaway view taken along line 3—3 of FIG. 2.

One embodiment of the invention is illustrated in FIGS. 2 and 3 in which a TFEL panel 10 includes an active area 12 covered by a solid seal material 14. The perimeter 16 of the solid seal material extends beyond the outer perimeter of the active area 12.

The seal material is originally formed over the active area of the panel when it is in a viscous liquid or gel state. Once formed, the seal material is cured until it reaches a hardness that is no greater than 40 durometers (Shore A). Several types of sealing or potting compounds are available for this purpose. A preferred product designated as UR 164 manufactured by Thermoset Plastics, Inc. is a two-part urethane material which is cured at 90° C. for one hour. Another heat curable material is made by Wacker Silicones Corp. and is known as RTV silicone rubber V-111. This material cures at 135° C. for a minimum time of 15 minutes to a maximum of ½ hour. Lower temperatures are suggested if the longer time is to be used.

Figure 4:
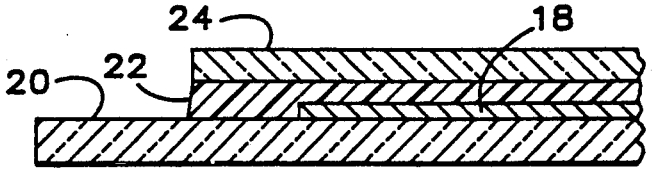
FIG. 4 is a partial side cutaway view of a TFEL panel utilizing solid seal material and a glass cover plate.
Figure 4A:
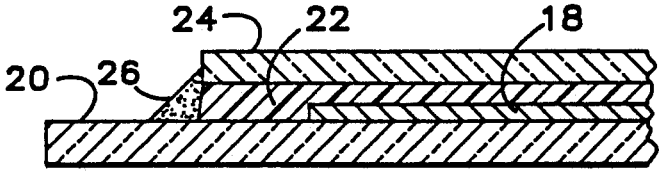
FIG. 4*a* is a partial side cutaway view of the TFEL panel of FIG. 4 additionally having an adhesive vapor barrier.

Because the solid seal material should cure to a hardened state of no more than 40 durometers (Shore A) the seal is still porous enough to admit moisture. Therefore, in environments where moisture is a problem, it may be desirable to add a protective cover on top of the solid seal material to form a vapor barrier. In FIG. 4 the active area 18 of the TFEL panel 20 is covered by solid seal material 22. A protective cover 24, which may be made of glass, lies on top of the solid seal material. Referring to FIG. 4*a*, the protective cover 24 may be affixed to the panel 20 by an adhesive vapor barrier 26. The adhesive vapor barrier 26 may be made of a water proof epoxy such as EPO-TEK H77 made by Epoxy Technology, Inc.

Placement of the protective cover 24 over the solid seal material 22 may occur when the seal material 22 is in a gel-like state. A dome or mound of the material may be formed in the middle of the TFEL panel 20 and the cover 24 may be pressed downwards squeezing excess seal material out from under the cover at its edges. The excess may then be removed and the solid seal material cured with the protective cover in place. In this way, the possibility of bubbles forming in the seal material is largely eliminated.

Figure 5:
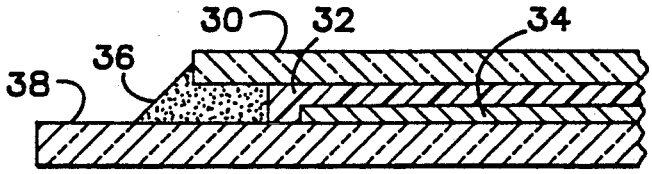
FIG. 5 is a partial side cutaway view of a second form of the invention employing an overhanging protective cover and an adhesive vapor barrier.

Not all available solid seal material is heat cured. A second form of the invention is shown in FIG. 5 which uses solid seal material which may be cured by ultraviolet light. In this embodiment the protective cover 30 overhangs the solid seal material 32 which is placed over the active area of the TFEL panel 34. The solid seal material used for this purpose may be of the type made by Loctite Corporation under the product name NUVA-SIL 5088. This material is cured by exposure to ultraviolet light. The panel may be constructed according to the method of FIGS. 4 and 4*a*, but then the inner edge of the protective cover may be masked during the curing step. This means that there will be a portion of the solid seal material 32 located under the edge of the protective cover which will not be cured. This excess material may be rinsed away with a solvent thereby creating an overhang for the protective cover. With the overhang an adhesive vapor barrier 36 may be formed by wicking the epoxy material underneath the protective cover 30 affixing it to the panel 38. This provides even greater protection against moisture since the adhesive vapor barrier is even more substantial with this embodiment.

Other types of encapsulating material can be used other than those listed above. The material can be applied by screening, spraying, pouring or blading and curing may occur by heat ultraviolet light or by chemical reaction where a two-part mixture is involved. All of the above methods will work as long as the final material hardness does not exceed 40 durometers (Shore A). Furthermore, it is not necessary that a protective cover be used in each and every case. The choice to provide a protective cover and an adhesive vapor barrier will depend in part upon the intended environment of use.

The hardness of 40 durometers (Shore A) is important to the invention because at this degree of hardness the encapsulating material has formed a solid state which maintains the structural integrity of the panel, but at the same time may still promote the self-healing properties of the panel during panel burn-in. Short circuits across the panel that may occur during burn in are confined to small pin hole defects as the aluminum electrode burns away from the location of the short circuit. Encapsulating material of a hardness no greater than 40 durometers (shore A) allows the electrode directly in the vicinity of the short circuit to burn away without propagating down an entire row or column which would likely happen if heat or vapor could not dissipate through the encapsulating material. Self-healing is important in such panels because short circuits across the thin film stack can and do occur. If limited to small pin holes these defects are unnoticeable.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited on by the claims which follow.

What is claimed is:

1. A method of encapsulating the active area of a TFEL panel comprising the steps of:

(a) depositing a gel material over the active area of the TFEL panel;

(b) placing a protective cover atop the gel material and depressing the protective cover so as to squeeze excess material out from underneath the protective cover along the edges thereof;

(c) curing the gel material to a predetermined degree of hardness whereby the gel material enters a solid state; and (d) sealing the protective cover against the panel with an adhesive vapor barrier.

2. The method of claim 1 wherein the material is cured to a hardness of no greater than 40 durometers (Shore A).

* * * * *